United States Patent [19]

von Besser et al.

[11] 4,168,084

[45] Sep. 18, 1979

[54] SKI BINDING HAVING A STEP-IN CLAMPING DEVICE

[75] Inventors: Kurt von Besser, 218 S. Hoyne Ave., Chicago, Ill. 60612; Daniel R. Gutting, Jr., Skokie, Ill.

[73] Assignee: Kurt von Besser, Chicago, Ill.

[21] Appl. No.: 873,604

[22] Filed: Jan. 30, 1978

[51] Int. Cl.[2] ..... A63C 9/00

[52] U.S. Cl. ..... 280/618; 280/626

[58] Field of Search ..... 280/618, 632, 631, 626, 280/620

[56] References Cited

U.S. PATENT DOCUMENTS

| | | | |
|---|---|---|---|
| 3,249,365 | 5/1966 | Beyl | 280/626 |
| 3,697,094 | 10/1972 | Salomon | 280/632 |
| 3,797,843 | 3/1974 | Salomon | 280/618 |
| 3,874,685 | 4/1975 | von Besser | 280/618 |
| 3,944,237 | 3/1976 | Teague, Jr. | 280/618 |
| 3,964,759 | 6/1976 | Salomon | 280/626 |
| 3,966,218 | 6/1976 | Beyl | 280/631 X |

FOREIGN PATENT DOCUMENTS

| | | | |
|---|---|---|---|
| 2269982 | 12/1975 | France | 280/631 |

*Primary Examiner*—Joseph F. Peters, Jr.
*Assistant Examiner*—Milton L. Smith
*Attorney, Agent, or Firm*—Wegner, Stellman, McCord, Wiles & Wood

[57] ABSTRACT

A ski binding includes a step-in lever or latch for releasably clamping a ski boot to a sole plate. The latch is pivotally mounted on the bight of a U-shaped bail having ends pivoted within the sole plate. As the ski boot is stepped downwardly, the latch is rotated and translated upwardly by camming action of an arcuate undersurface eccentrically located with respect to the bight. A wedge surface interconnecting the arcuate undersurface and an opposed surface frictionally engages the ski boot and continues pivoting of the latch until an opposed latching surface moves from one side of the bail to the other in order to provide an over-center toggle action to cause the latching surface to overlie the ski boot heel extension.

19 Claims, 8 Drawing Figures

SKI BINDING HAVING A STEP-IN CLAMPING DEVICE

BACKGROUND OF THE INVENTION

This invention relates to ski bindings, and more particularly, to step-in latches or clamping devices forming part of such ski bindings.

Plate type ski bindings utilize a sole plate which is releasably secured between toe and heel retainer units which release the sole plate in a fall. It has become known to provide step-in action for capturing the sole plate to both the toe and heel retainer units. A ski boot is releasably clamped to the sole plate by a heel lever which is manually moved over center. The ski boot then remains clamped to the sole plate even during a fall. Unfortunately, the skier has had to go through a series of relatively contorted moves, hampered by the rigidity of the ski boot, to manually flip the heel lever over the heel extension of his ski boot when first entering the binding, thus losing the convenience and advantages of a step-in type binding in which the skier merely orients his boot properly with respect to the binding on the ski and exerts a downward force on the boot to automatically capture the boot in the binding.

Some attempts have been made to provide a step-in heel lever for clamping a ski boot to a sole plate. All such step-in devices heretofore known have, in common with so-called step-in ski bindings of the nonsole plate type, many moving parts, springs and the like.

Frequently, the large number of moving parts make the bindings difficult to adjust and, of course, the greater the number of moving parts, the greater the probability of part failure. Springs will frequently fatigue after prolonged use with the result that the binding, though operable, will require manual securement rather than allowing step-in performance.

And, of course, the large number of parts employed in such bindings necessarily increases the expense of manufacture thereof as well as makes servicing of the same more difficult.

SUMMARY OF THE INVENTION

In accordance with the present invention, the disadvantages of prior step-in clamping devices have been eliminated. A new step-in device, particularly adapted to clamping a ski boot to a sole plate, features a minimal number of parts and avoids the use of springs altogether.

According to one embodiment of the invention, there is provided a clamping means which is adapted to be movably mounted with respect to a ski, a sole plate, or the like, and including a clamp element for engaging a ski boot extension. A wedge element is engageable to the side surface of the ski boot extension as the ski boot is moved downwardly moving the clamping means until the clamping element engages the ski boot extension.

The invention also contemplates a ski binding including a clamping means having a closed position for engaging a clamping element against a ski boot extension to form the sole restraint that engages the ski boot extension and includes release means manually movable to disengage the clamping element from the ski boot extension and to lift the ski boot extension upwardly and away from the underlying ski or sole plate.

The invention also contemplates a binding including a clamping means rotatable and translatable with respect to a pivot axis and including a clamp element which engages a ski boot extension and having an arcuate cam having a changing radius with respect to the pivot axis. Retainer means are provided for connecting the clamping means about the pivot axis to a ski or underlying sole plate and for orienting the cam on a camming surface affixed with respect to the ski or sole plate. Means are provided which are responsive to downward motion of the ski boot towards the plate or ski for rotating the cam to cause the pivot axis to rise upwardly until the clamped element engages the ski boot extension.

In a highly preferred embodiment, the invention contemplates a latch including a bail having ends adapted to be pivoted to a ski, a sole plate, or the like, and a bight. A latch is pivoted to the bight. The latch has an arcuate undersurface which is eccentrically located with respect to the bight, an opposed latching surface adapted to overlie an extension of a ski boot, and a surface spaced from the bight interconnecting the undersurface and the opposed surface for frictional engagement with an extension of a ski boot. The latch is rotatable and translatable between a position wherein the undersurface and the interconnecting surface are disposed between the bight and the ends of the bail and the opposed surface is on one side of the bail and a second position wherein the opposed surface is on the other side of the bail. When a ski boot extension is frictionally engaged with the interconnecting surface and a downward force is exerted thereon, the latch will pivot on the bight from the first position toward the second position, the arcuate undersurface pivoting the bail such that the opposed latching surface will move from one side of the bail to the other to provide an over-center toggle action to cause the latching surface to overlie a ski boot extension.

Other objects and advantages will become apparent from the following specification taken in connection with the accompanying drawings.

DESCRIPTION OF THE PREFERRED EMBODIMENTS

Figure 1:
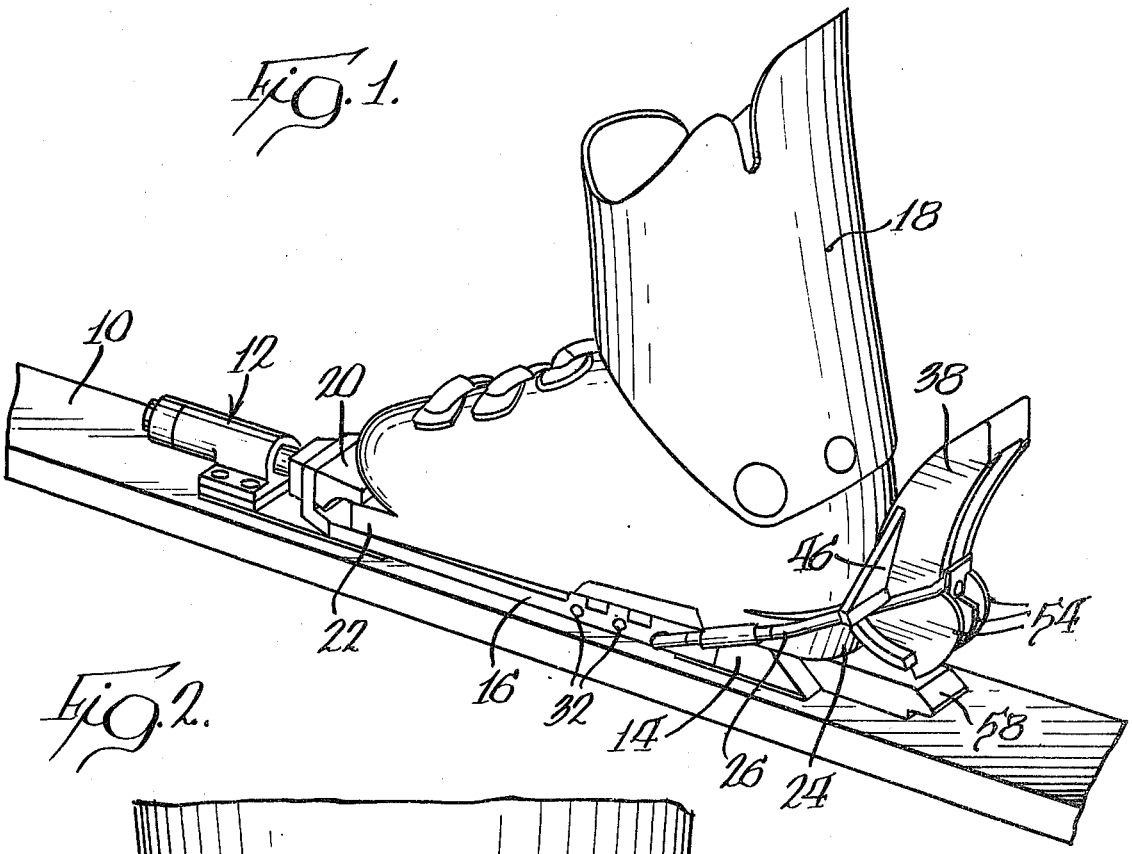
FIG. 1 is a perspective view of a ski binding made according to the invention, mounted on a ski, shown fragmentarily, and capturing a ski boot.

An exemplary embodiment of a latching or clamping mechanism made according to the invention for use as part of a ski binding is illustrated in the drawings in connection with a sole plate type of binding and as the means by which the rear of a ski boot is releasably clamped to the sole plate. However, it is to be understood that the invention is not restricted to use in sole plate types of bindings, but may be employed with efficacy in nonsole plate bindings as well. It will also be appreciated that while, in general, the invention will find its major utility in connection with releasably securing the rear of a ski boot to a ski or a sole plate, it may, for example, be utilized to releasably secure the toe of a ski boot to a binding as well. One example of the latter type of use would be in a cross-country ski binding. With the foregoing in mind, the exemplary embodiment will now be described in detail.

With reference to FIG. 1, there is seen a ski 10 having, on its upper surface, a forwardly located toe release unit 12 of conventional construction and a known rearwardly located heel release unit 14, which may be of step-in construction. A sole plate 16 is releasably captured by the primary release units 12 and 14 and a ski boot 18 is, in turn, releasably captured to the sole plate 16 by secondary release means.

More particularly, the front of the sole plate 16 includes a vertically adjustable retainer such as a toe ear bracket 20 for capturing a forward extension 22 of the sole of the ski boot 18. A rear retainer in the form of a step-in heel lever or latch, made according to the invention, captures a rearwardly directed heel extension 24 of the sole of the ski boot 18. The latch or clamp capturing the heel extension 24 is formed of two principal elements. The first is a retainer pivotally connected to the sole plate, the ski, or the like and comprising a generally U-shaped bail 26 having generally parallel legs 28 terminating in ends 30 which are freely pivotally received and retained within apertures 32 in the sides of the sole plate 16. As is well known, the apertures 32 provide a gross length adjustment for longitudinal movement of the ends 30 to accommodate ski boot soles of different length.

Preferably, the entire U-shaped retainer bail 26 is formed of spring wire, rather than cable, to insure that the latch cannot turn nor twist on the bail 26. The legs 28 of the bail 26 are of adjustable length and, to this end, turnbuckles 34 are provided in each whereby the length of the wire legs 28 may be selectively shortened or lengthened within the limits permitted by the turnbuckles 34 to provide fine length adjustment in a longitudinal direction. Further adjustment to properly position the bail 28, as will be seen, can be had by selectively disposing the ends 30 in any one of the series of apertures 32.

Lastly, the bail 26 includes a centrally disposed bight 36 (FIG. 2) which is generally parallel to the pivot axis defined by the ends 30 and which serves as a pivot axis for a latch 38.

Figure 2:
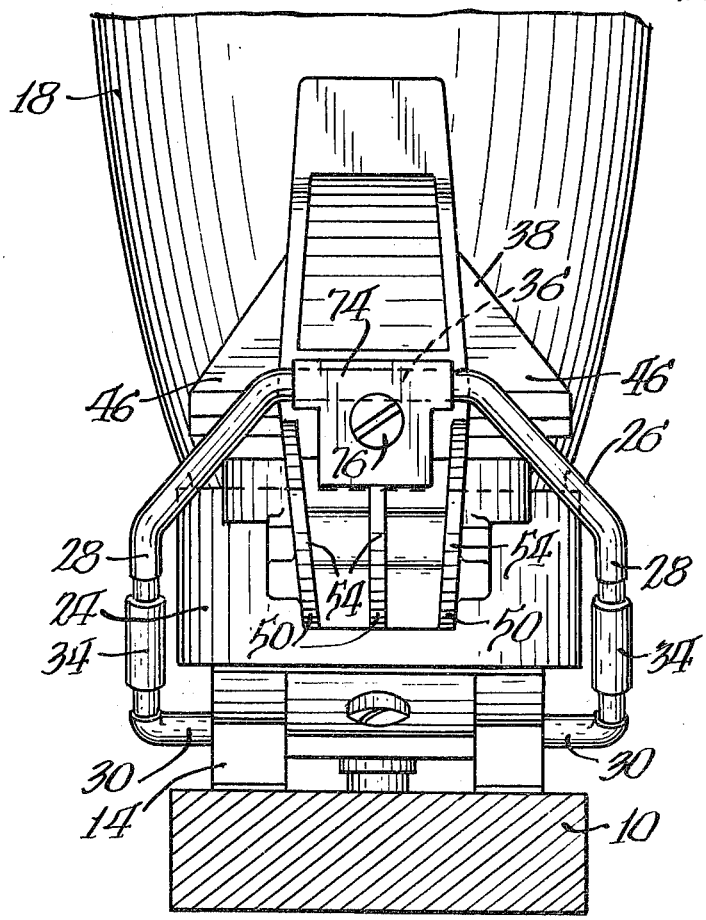
FIG. 2 is a vertical section taken from a location to the rear of the binding.
Figure 3:
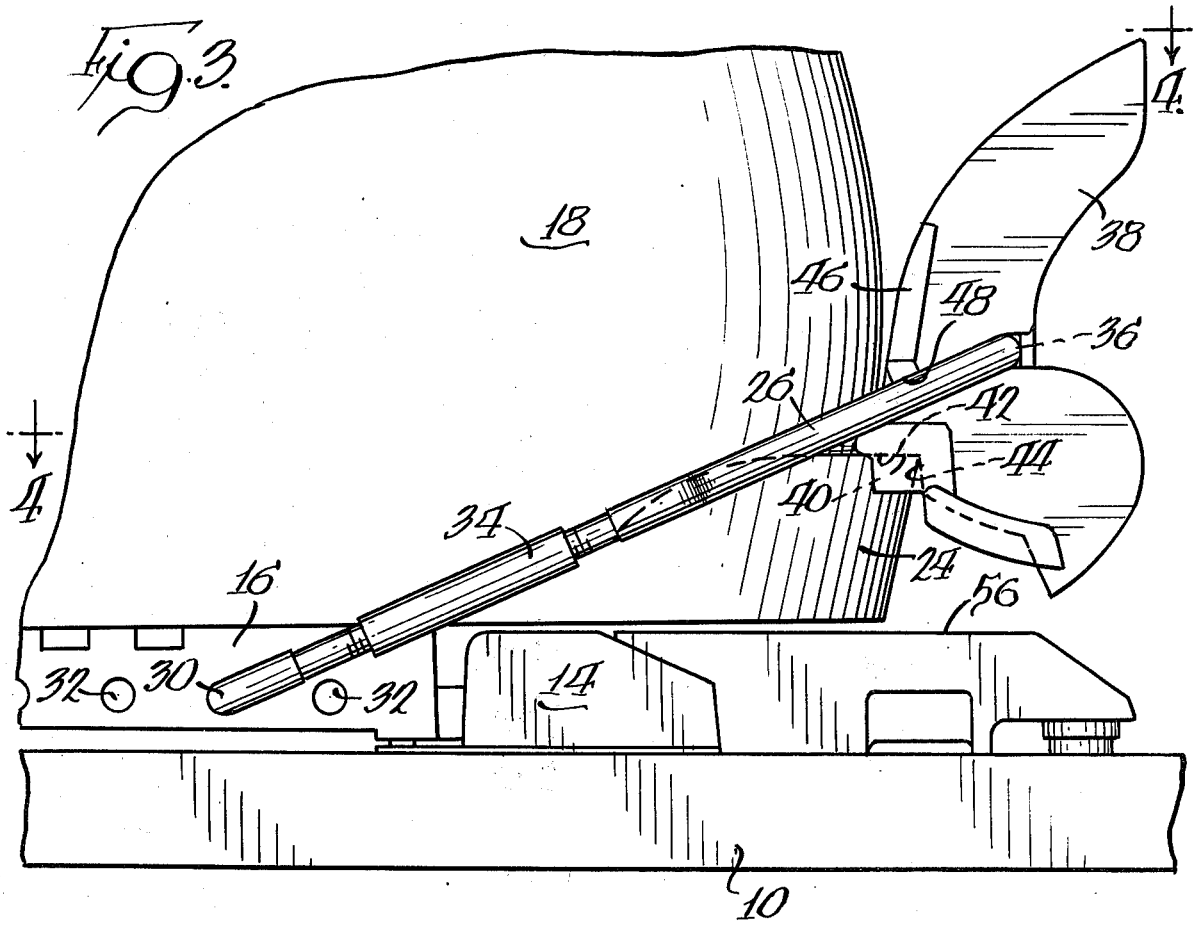
FIG. 3 is a fragmentary, side elevation illustrating a boot latched in position.

FIGS. 1–4, inclusive, illustrate the latch 38 in a latching or clamping position clamping the rear extension 24 of the ski boot 18 to the sole plate 16. The latch 38 is formed with a clamp or latching surface which is defined by a shoulder or recess 40 which, in turn, is defined by intersecting surfaces 42 and 44, as best seen in FIG. 3. The hold-down surface 42 bears against the upper surface of the extension 24 to hold the sole of the boot 18 firmly against the sole plate 16 while the surface 44 bears against the rear surface of the extension 24 to force the boot 18 forwardly such that the front extension 22 is firmly received beneath the toe ear bracket 20.

Figure 4:
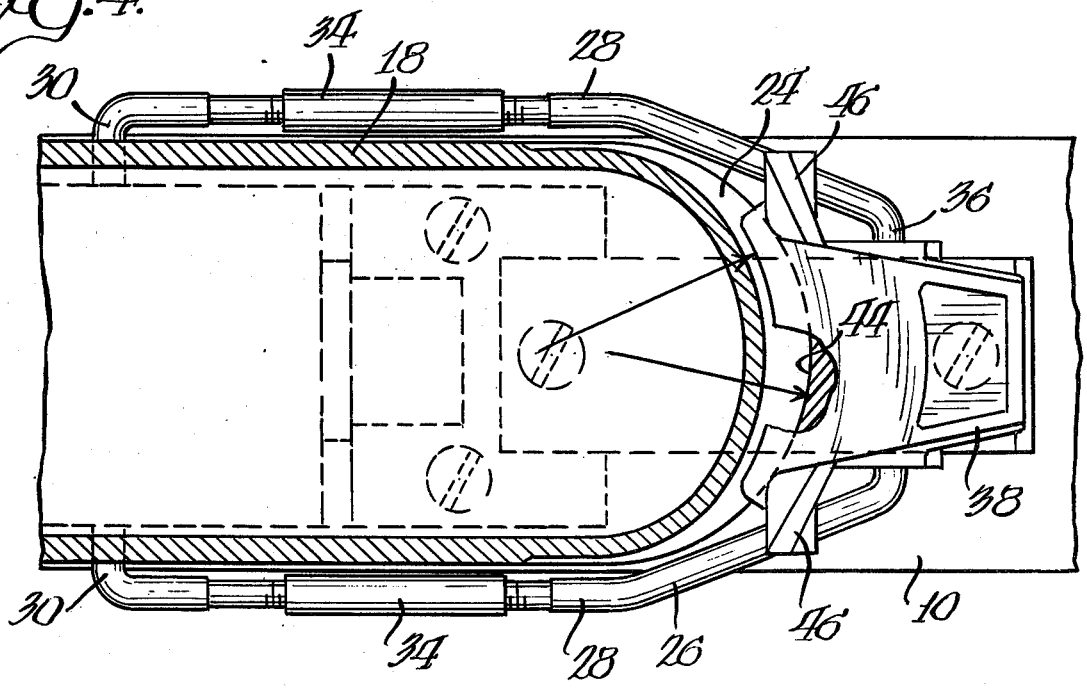
FIG. 4 is a sectional view taken approximately along the line 4—4 in FIG. 3.

The precise configuration of the surfaces 42 and 44 defining the clamp or latching surface is selected to fit the extension 24 of most ski boot soles which are to be latched in place. In general, the surface 42 is planar, as seen in FIG. 3, while the surface 44 is arcuate, as seen in FIG. 4, and has a radius of curvature on the order of that of the extension 24.

The latch 38 is freely pivotally mounted on the bight 36 of the bail 26 and, as viewed in FIG. 3, is in its counterclockwisemost position about that pivot axis. In this position, the latching surface will be below the bail 26 and between the bight 36 and the ends 30, as illustrated. A pair of wing-like stops or extensions 46 projecting laterally from opposite sides of the latch 38 have undersurfaces 48 adapted to engage the legs 28 of the bail 26 to limit counterclockwise movement to the position illustrated in FIG. 3. The surfaces 48 act as stops and are highly advantageous when contrasted to the adjustable screw used as a stop in other latch configurations since they do not require adjustment and always will limit the maximum forward position of the latch 38 when in the latching position, irrespective of the contour of the rear of the boot 18 above the extension 24.

Figure 5:
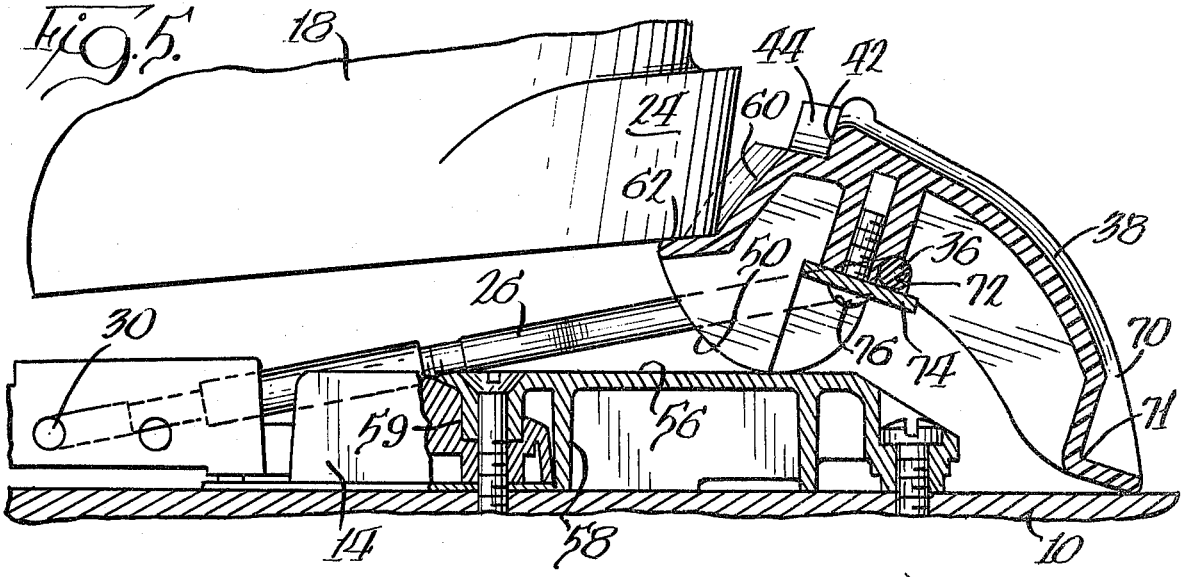
FIG. 5 is a view similar to FIG. 3 but illustrating the configuration of the components relative to each other as entry into the binding is initiated with parts shown in section for clarity.

Referring to FIG. 5, the latch 38 is illustrated in its clockwisemost position about the bail 36. Such a position is that in which the latch 36 is disposed when entry into the binding is to be initiated. It will be observed that the latch 36 has an arcuate cam or arcuate undersurface 50 which is eccentrically located with respect to the pivot point of the latch defined by the bight 36 and, specifically, when in the entry position, is disposed between the bight 36 and the ends 30 of the bail 26.

Figure 6:
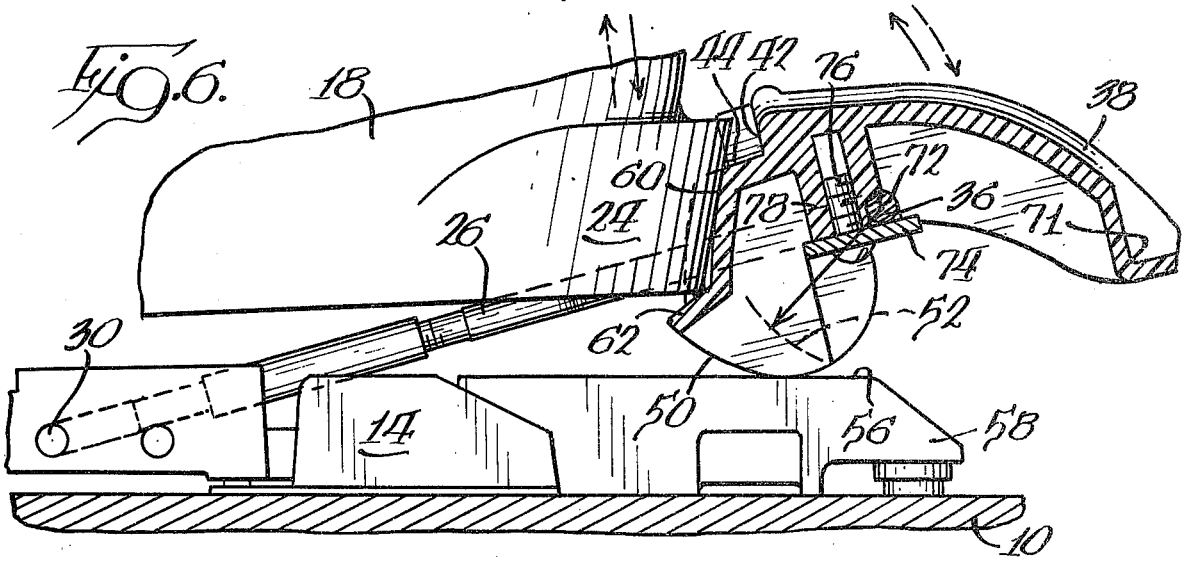
FIG. 6 is a view similar to FIG. 5 but illustrating the relative relationship of the components at a subsequent step in the entry process.

A highly desirable configuration of the arcuate undersurface 50 is that illustrated in the drawings, although other configurations may be used. However, it is important that, considering the bight 36 as a center, that the arcuate surface 50 having an increasing radius with respect to that center, as can be ascertained by comparison of the arcuate surface 50 with a dotted line 52 shown in FIG. 6 representing a constant radius from the bight 36. This causes the pivot axis of the bight 36 to be vertically transposed upward as the latch is rotated about the bight 36.

As best seen in FIG. 2, the arcuate cam or undersurface 50 is defined by the lowermost extent or edge of three, downwardly extending, laterally spaced ribs or tongues 54. If desired, the surface 50 could be solid rather than in the three segments provided by the tongues 54 but the use of ribs or tongues is preferred in that the omission of material between the tongues provides some weight savings in the binding and considerably reduces the cost of the material required to form the latch 38.

The arcuate undersurface 50 rides over a surface 56 which is planar and parallel to the ski upper surface, and which may be a rearward extension of the heel unit 14 or, as illustrated herein, a separate support or platform 58 molded as an integral plastic piece. As best seen in FIG. 5, the platform 58 may be fixedly secured to the upper surface of the ski by a pair of screws. The forward screw extends into a downwardly extending sleeve 59 which snugly engages the rear countersunk recess in the heel retainer unit 14.

The platform 58, latch 38, and U-shaped bail 26 may be made available to skiers as a kit for converting an older model plate binding into a plate binding having the present step-in heel lever. The rear screw securing the heel retainer unit 14 to the ski would be removed, and the sleeves 59 of the platform 58 inserted in place thereof, after which the screw would be replaced through the sleeve 59 to secure the platform 58 to the ski. A rear screw would then be inserted through the rearmost bore in the platform 56 into the ski 10. Finally, the old U-shaped bail and heel lever would be removed, and the new U-shaped bail 26 and heel lever 38 shown in the drawings would be substituted so as to complete the conversion of the old plate binding into a new binding with a step-in heel lever.

The arcuate undersurface 50 together with the planar surface 56 define a cam means for pivoting and translating the latch 38 from the entry position illustrated in FIG. 5 to the over-center clamp position illustrated in FIG. 3. The three ribs or tongues 50 are utilized to ensure that at least a pair of the tongues 50 will engage the surface 56 to provide the desired camming action.

Figure 7:
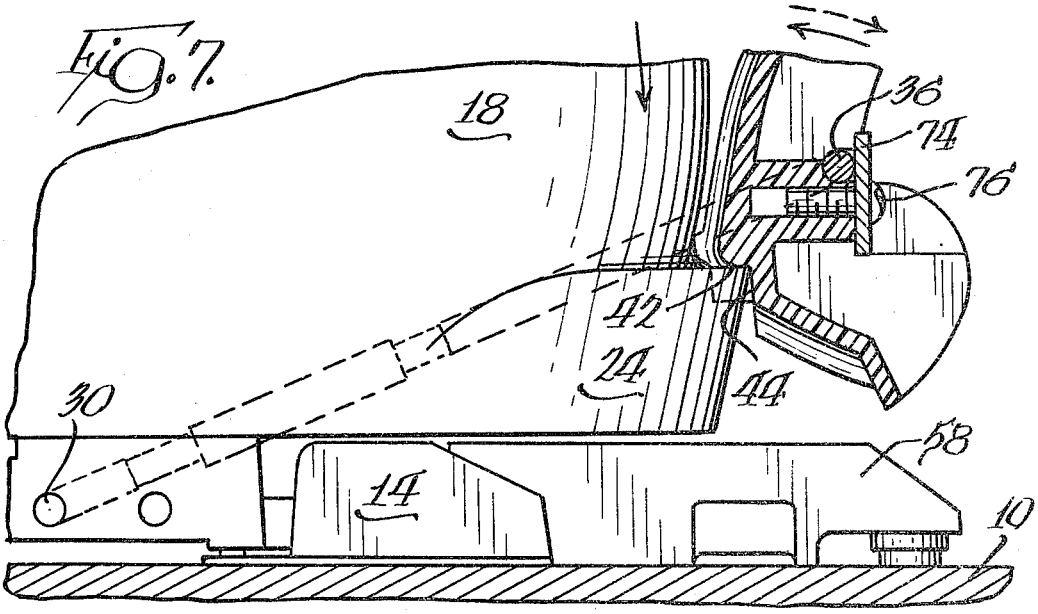
FIG. 7 is a view similar to FIGS. 5 and 6 but illustrating the relationship of the components after entry has been completed.

As best seen in FIGS. 5–7, a jam or wedging surface 60 is near the top of an interconnecting guide surface between the latching surface 42, 44 and the arcuate undersurface 50. The interconnecting guide member with the wedge surface 60 includes a forwardly extending pressor lip or projection 62 which is engaged by the underside of the boot heel extension 24 so that a downward force may be applied to the latch 38 of the left of the bight 36, as viewed in the drawings. As will appear, both the lip 62 and the wedge surface 60 form a means responsive to downward motion of the ski boot heel for rotating the arcuate cam 50 over the underlying planar surface 56 to translate upwardly the pivot axis of the latch.

As can be seen, the guide surface is concave with respect to a substantially vertical axis, that is, the same opens forwardly on the ski and this configuration serves to receive the heel extension 24 and center the same with respect to the binding to ensure that the boot 18 is properly aligned on the ski 10. As also can be seen in FIGS. 5–7, the guide surface is slightly convex with respect to a horizontal axis, such as that defined by the bight 36 or the ends 30, with the wedge surface 60 forming a bulge.

The configuration of the convex curvature of the surface 60 must be such that as the latch 38 rotates from an entry position to a clamping position, there is sufficient frictional engagement between the generally vertical side of the heel extension 24 and the wedge surface 60 so that the continued downward force applied to the boot 18 will cause the latch 38 to continue to rotate, even as the undersurface of the heel extension 24 disengages the lip 62. Further downward force is translated through the wedge 60 to the latch 38 in order to continue rotation of the latch about the bight 36 until the latch travels over center and thus flips into the clamped position shown in FIG. 7.

The latch 38 has a rearwardly curved extension 70 or handle. As seen in the drawings, the extension 70 is arcuate and terminates in a recess or cup 71 for receiving the tip of a ski pole when the skier wishes to release the latch from engagement with the ski boot. By placing the ski pole tip in the pocket 71 and pushing the ski pole downwardly and rearwardly, the latch 38 can be rotated over center to its release position. As the latch rotates to the rear, as shown by the dashed arrows in FIGS. 5–7, the wedge surface 60 will again engage the side of the heel extension and lift the ski boot upwardly. The lip 62 will be rotated under the heel extension and will further serve to lift the ski boot sole out of engagement with the sole plate. This action aids in breaking ice and frozen snow which may otherwise cause the bottom of the ski boot to tend to remain secured to the sole plate.

The latch 38 is freely rotatably retained on the bight 36 by disposing the bight in aligned notches 72. A retaining plate 74 is disposed to close the notches 72 after the bight 36 is located therein and is secured in place by a threaded fastener 76 received in a boss 78 integrally formed with the latch 38.

In general, the entire latch 38, with the exception of threaded fastener 70 and the retaining plate 74, may be an integral piece, preferably formed of plastic or the like, it being desirable that the arcuate undersurfaces 50 have a relatively low coefficient of friction, as will be seen.

Operation is as follows. With reference to FIG. 5, the latch 38 when no ski boot is located therein will be automatically disposed in a clockwisemost position, due to the action of gravity (when the ski 10 is properly oriented in a generally horizontal plane). When the skier last released the latch 38, it would have automatically fallen rearward to its open position shown in FIG. 5, ready to receive the ski boot heel. In this opened or rest position, the bail 26 is substantially adjacent the top of the ski 10. The wearer of a boot will dispose the toe extension 24 beneath the toe ear bracket 20 in a manner well known. It will be observed that, at this time, the latching surface 42, 44 is above the bail 26, the interconnecting surface 60 is disposed between the bight 36 and the ends 30 and the arcuate undersurface is similarly disposed between the bight 36 and the ends 30. The heel extension 24 will be brought into contact with the lip 62 and a downward step-in force exerted thereon. This, in turn, will cause the latch 38 to pivot about the pivot axis provided by the bight 36 in a counterclockwise direction. At the same time, because of the eccentricity of the arcuate undersurface 50 with respect to the pivot point 36, rotation of the latch 38 will drive the bail 26 upwardly about its pivot axis provided by the ends 30, thereby translating the latch 38 simultaneously with the rotation thereof.

As such rotation continues, tight frictional engagement between the wedge surface 60 and the side of the heel extension 24 will increasingly occur, forward movement of the boot 18 to relieve such wedging action being precluded by the toe ear bracket 20.

At a point intermediate those illustrated in FIGS. 6 and 7, the lip 62 will no longer underlie the boot, but the frictional engagement with the wedge surface 60 will continue to cause the latch 38 to rotate in a counterclockwise direction due to continued downward movement of the boot 18. At a later point in time, the latching surface 42, 44 will pass through a plane encompassing the pivot axis of the bail 26 defined by the ends 30 and the pivot axis of the latch 38 defined by the bight 36, and will flip over center to the position illustrated in FIG. 7. At this time, the surface 42 will have moved into overlying relation to the extension 24 while the surface 44 will be exerting a forward force on the boot 18 to continue to maintain the same in firm engagement with the toe ear bracket 20. The latch thus undergoes an over center, toggle action when moving from the entry position to the latch position as the latching surfaces pass through the aforementioned plane.

Figure 8:
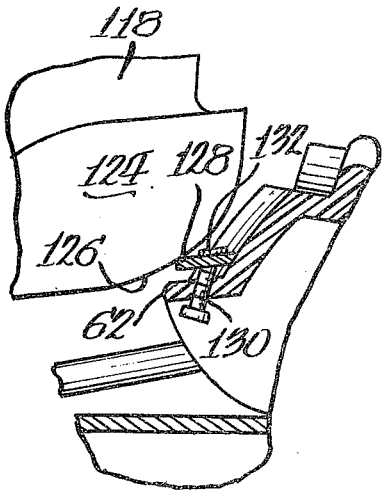
FIG. 8 is a fragmentary view of a modified embodiment of the invention.

FIG. 8 illustrates a modified embodiment of the invention wherein the upper surface of the lip 62 is adjustable so as to accommodate boot configurations other than those illustrated in FIGS. 1–7. In FIG. 8, a boot 118 has a rearwardly directed extension 124 and the undersurface 126 of the heel extension 124 is made arcuate, principally to aid the wearer of the boot in walking when not in skis.

In order to ensure engagement of the rounded heel extension 124 with the lip 126, a plate 128, which is vertically adjustable, serves as the upper surface of the lip 62. A pair of threaded fasteners 130 (only one of which is shown) extend through the lip 36 and are threaded in bores therein. The ends of the fasteners 130 are freely rotatably received in bores (not shown) in the plate 128 and the upper ends of the fasteners 130 are deformed as at 132 over the upper surface of the plate to capture the same. Thus, the plate 128 will move upwardly or downwardly with the threaded fasteners 130 and cannot be inadvertently disassociated therefrom. Preferably, one of the fasteners 130 is disposed in each of the spaces between the tongues 50. In all other respects, the embodiment illustrated in FIG. 8 is identical to that previously described.

From the foregoing, it wll be appreciated that a latch or clamping mechanism made according to the invention provides all the advantages of step-in mechanisms heretofore known and avoids many disadvantages thereof. The same employs but two principal components and they are movably interrelated only by a pivot. The use of separate springs, detents, or the like, is totally avoided. Consequently, a latch or clamping mechanism made according to the invention is inexpensive to fabricate, requires little maintenance, is easy to service and not at all prone to failure. While a raised platform 56 has been provided for the arcuate cam 50, it will be appreciated that the platform could be eliminated and the arcuate undersurface 50 could be increased in size to directly contact the upper plane of the ski 10. Other changes will be apparent in view of the above teaching.

We claim:

1. A ski binding having a step-in device for releasably clamping an extension of a ski boot, comprising:

a latch rotatable about a pivot axis and having a clamp surface for engaging the ski boot extension, at least one fin having an arcuate end which forms an arcuate cam having an increasing radius with respect to the pivot axis, means responsive to downward motion of the ski boot extension for rotating the fin over an underlying surface to cause the pivot axis to translate upwardly as the increasing radius of the arcuate end rotates over the underlying surface until the latch flips over center in order to engage the clamp surface against the ski boot extension, and retainer means pivotally connecting the latch about the pivot axis to the ski binding with the arcuate cam oriented on the underlying surface.

2. A ski binding having a step-in device for releasably clamping an extension of a ski boot, comprising:

a latch pivotally mounted about a pivot axis with an arcuate undersurface eccentrically located with respect to the pivot axis, a clamp surface for engaging the ski boot extension, a wedge surface frictionally engageable with a side surface of the ski boot extension, a member interconnects the arcuate undersurface to the clamp surface with the wedge surface forming a portion of the interconnecting member and engageable with the side surface of the ski boot extension as the ski boot is moved downwardly to rotate the arcuate undersurface against an underlying surface in order to translate the clamp surface upwardly and over the ski boot extension.

3. The ski binding of claim 2 including a sole plate releasably securable to the ski boot, a first retainer for engaging the other extension of the ski boot, a second retainer comprising a bail having ends pivotally secured to the sole plate and a bight pivotally secured to the latch with the interconnecting member located between the bight and the ski boot extension side surface, the downward force of the ski boot extension side surface against the wedge surface rotating the eccentric arcuate undersurface about the bight to raise the latch over the bail and thereby flip the clamp surface against the ski boot extension.

4. The ski binding of claim 2 wherein the latch includes release means manually movable to disengage the clamp surface from the ski boot extension and to engage the wedge surface against the side surface of the ski boot extension with continued manual movement of the latch rotating the eccentric arcuate undersurface about the bight to raise the wedge surface and thereby lift the ski boot extension upwardly with respect to the ski.

5. A ski binding having a step-in device for releasably clamping an extension of a ski boot, comprising:

a bail having a bight and ends adapted to be pivoted with respect to a ski surface, a latch pivoted to said bight, said latch having an arcuate undersurface eccentrically located with respect to said bight, an opposed latching surface adapted to overlie the ski boot extension, and a member interconnecting said undersurface and said latching surface and including a boot engageable surface for engagement with the ski boot extension, said latch being rotatable and translatable between a first position wherein said undersurface and said interconnecting member are disposed between said bight and said ends and said latching surface is on one side of said bail and a second position wherein said latching surface is on the other side of said bail, whereby when the ski boot extension is engaged with said boot engageable surface and a downward force is exerted thereon, said latch will pivot on said bight from said first position toward said second position, said arcuate undersurface pivoting said latch such that said latching surface will move from said bail one side to said bail other side to provide an over-center toggle action.

6. The ski binding of claim 5 wherein said boot engageable surface includes a lip at the juncture with said arcuate undersurface, the lip extending from said bight toward said ends when said latch is in said first position.

7. The ski binding of claim 6 wherein the surface of said lip is adjustable toward and away from said latching surface.

8. The ski binding of claim 7 wherein said lip comprises a plate and at least one threaded element threaded to said latch and mounting said plate with rotation of said threaded element effecting adjustment of said lip surface toward and away from said latching surface.

9. The ski binding of claim 5 wherein said interconnecting member is concave with respect to an axis extending generally perpendicular to said bight.

10. The ski binding of claim 5 wherein said interconnecting member is slightly convex with respect to an axis extending generally parallel to said bight.

11. The ski binding of claim 5 wherein said latch includes at least one laterally extending stop surface adapted to engage said bail remote from said bight when said latch is in said second position to limit movement of said latch on said bight.

12. The ski binding of claim 5 wherein said latch includes a plurality of laterally spaced, downwardly extending tongues defining said arcuate undersurface.

13. The ski binding of claim 5 including a platform fixedly secured to the ski and having an upper surface generally planar with respect to the ski for engaging the arcuate undersurface.

14. A ski binding having a step-in device for releasably clamping an extension of a ski boot, comprising:

a generally U-shaped bail having a center bight and a pair of legs pivotally mounted with respect to the ski binding, a springless latch pivotally mounted to the center bight and having a single lip extending slightly under the ski boot extension only during initial step-in movement of the ski boot, an eccentric arcuate cam extending generally from the lip to the center bight for maintaining the latch raised above an underlying surface prior to step-in, the lip being forced downwardly by the ski boot extension during step-in entry to rotate the eccentric arcuate cam over the underlying surface in order to raise the center bight until the latch flips over center and clamps against the ski boot extension.

15. The ski binding of claim 14 wherein the latch includes a wedge surface, located above the lip, which is rotated by downward movement of the lip into jam engagement with the side surface of the ski boot extension as the lip rotates away from the ski boot extension, the wedge surface continuing to rotate the latch in response to further downward movement of the ski boot extension until the latch flips over center.

16. The ski binding of claim 15 wherein the lip, the arcuate cam and the wedge surface are integrally formed as a single piece.

17. The ski binding of claim 15 wherein the latch includes a guide surface interconnecting the wedge surface to the lip, the guide surface having a curvature to center the ski boot extension with respect to the latch and to guide the ski boot extension onto the lip.

18. The ski binding of claim 14 wherein the latch has a handle extension which curves substantially away from the ski boot when the latch is clamping the ski boot extension, the handle extension terminating in a recess for receiving the tip of a ski pole.

19. The ski binding of claim 14 wherein the arcuate cam is formed by a plurality of separate fins having arcuate ends which rest on the underlying surface.

* * * * *